United States Patent [19]

Payne et al.

[11] 4,427,095

[45] Jan. 24, 1984

[54] MONITORING AND CONTROLLING LIFT POSITIONS

[76] Inventors: Reginald K. Payne, Stud Green Farm, Holyport, Maidenhead, Berkshire; John Trett, Ranch House, Frieth, Henley-on-Thames, Oxfordshire, both of England

[21] Appl. No.: 309,895

[22] PCT Filed: Feb. 6, 1981

[86] PCT No.: PCT/GB81/00016

§ 371 Date: Oct. 7, 1981

§ 102(e) Date: Oct. 7, 1981

[87] PCT Pub. No.: WO81/02288

PCT Pub. Date: Aug. 20, 1981

[30] Foreign Application Priority Data

Feb. 8, 1980 [GB] United Kingdom ..... 8004286

[51] Int. Cl.[3] ..... B66B 1/36

[52] U.S. Cl. ..... 187/29 R; 340/21

[58] Field of Search ..... 187/29; 340/19, 21

[56] References Cited

U.S. PATENT DOCUMENTS

| | | | |
|---|---|---|---|
| 3,414,088 | 12/1968 | Bruns et al. | 187/29 |
| 3,483,950 | 12/1969 | Simpson | 187/29 |
| 3,963,098 | 6/1976 | Lewis et al. | 187/29 |
| 4,203,506 | 5/1980 | Richmon | 187/29 |
| 4,368,518 | 1/1983 | Terazono et al. | 187/29 X |

*Primary Examiner*—B. Dobeck

*Assistant Examiner*—W. E. Duncanson, Jr.

*Attorney, Agent, or Firm*—Darby & Darby

[57] ABSTRACT

Lift car position control systems are described which use an elongate code bearing member which runs up and down the lift shaft. The member is preferably fixed though it may move with the lift car and cooperates with a moving or fixed detector respectively. The output of the detector is conveniently fed to a microprocessor which in dependence upon its programming and data concerning the lift and the building in which it is installed emits control signals to control the lift motor. The system is particularly valuable as allowing continuous monitoring of rope wear or stretch, lift car overloading, acceleration, rope slippage and like operating parameters.

12 Claims, 3 Drawing Figures

Figure 1A:
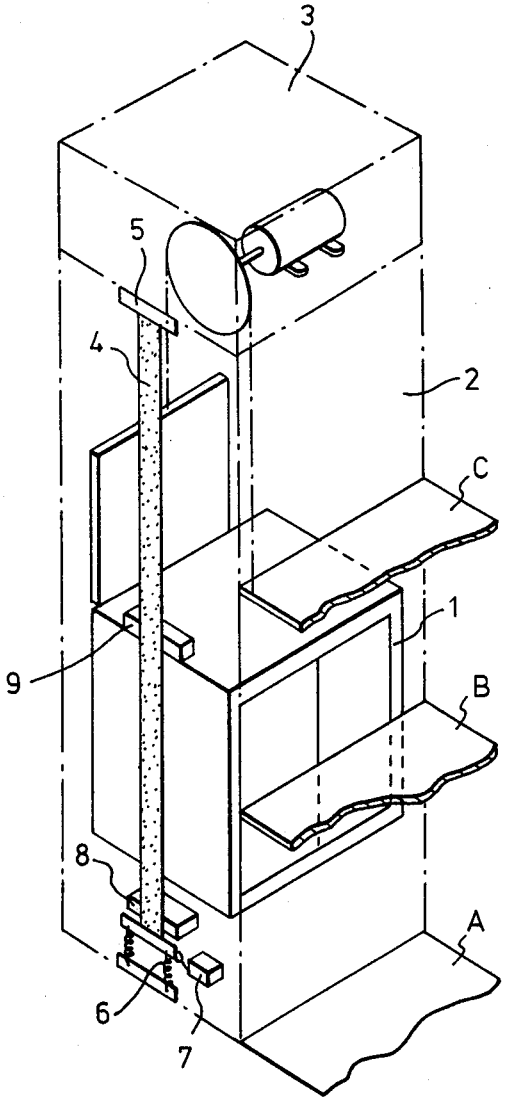

CAR FLOOR INDICATOR.
FLOOR A.
LEVEL SIGNAL. UP & DOWN
ACCELERATION DE-
CELERATION ZONE SIGNALS.
FLOOR B.
AS ABOVE.
ETC.
CAR SPEED.
TO SAFETY CIRCUITS.
24
LG
21
22
23
FLOOR LEVEL CODE SET ON SITE
μ P CONTROLLER -COMPARATOR
CAR ZONES LOOK UP TABLE
20
ACTUAL CAR POSITION CODE
COMPENSATION
16 TRACK
CAR POSITION
TAPE STRETCH
& BUILDING COMPRESSION
TAPE BREAK
4
9
8
7
6

MONITORING AND CONTROLLING LIFT POSITIONS

The present invention relates to systems for monitoring and controlling the positions of lifts, and for monitoring lift rope conditions, including overloading. The invention is described with particular reference to passenger lifts for use in buildings, but is of course applicable to lifts designed solely for lifting loads and also to lifts otherwise than in buildings e.g. on construction sites and in mine shafts.

In order to initiate appropriate motor and other control when operating lifts it is necessary to detect where the lift is. Accurate detection is necessary in order to initiate and control the deceleration of a lift as it reaches a desired floor position and in order to ensure that the lift stops with its floor level with the floor surrounding the lift shaft. It is also desirable accurately to detect where the lift is and which way it is going in order to provide a visual indication of position and direction both for passengers within the lift and for passengers waiting for the lift to arrive at the various floors. Such systems should also allow relevelling of the lift relative to the floors to compensate for example for stretch in the lift cables and movement in the building itself in which the lift is installed.

Two alternative approaches to monitoring and controlling lift position are known. The first of these is to construct conveniently in a lift motor room, a scale model of the lift in question. This may be driven by the main lift drive motor in such a way that the position of the lift in the model corresponds to that of the real lift in the shaft. By equipping the model with appropriate position sensors such as microswitches the lift itself may be controlled. The difficulties of building in small scale, e.g. 1:100, and the numerous mechanical moving parts make that system neither very accurate nor very reliable.

The alternative approach is to locate at spaced intervals down the lift shaft a variety of lift detection devices, usually of an electromechanical or photoelectric type. These are complex to instal, difficult to maintain (the lift generally has to be put out of action) and require substantial quantities of wiring. Additionally electromechanical devices such as uniselector switches are needed operatively connected to the various position detection devices in order to keep track of where the lift car is. This system is particularly complex if designed to operate properly even in the event of a transient power cut.

According to the present invention a lift position control system comprises, extending vertically down the lift shaft for substantially the whole of its height, an elongate code bearing member, having sequentially positioned along its length a sequence of coded units of information, and means co-operating with the elongate member and adapted to detect and decode the coded markings thereon and to derive therefrom information concerning the position of the lift and means for controlling the operation of the lift drive motor in dependence upon the positional information so detected.

Two alternative approaches may be employed: the coded elongate member may be suspended to extend substantially the whole height of the shaft and may be fixed in position. In this case the means for decoding the coded information on the elongate member preferably move with the lift car and are conveniently attached thereto. In an alternative, the decoding means may be fixed and the elongate member may be affixed to the lift car and move with it.

The elongate coded member may be made of any convenient material and the coding on it may be appropriately selected. The preferred material for the member is a flat strip e.g. of stainless steel. The preferred method of coding is to perforate the steel strip, notionally devided across its width into a plurality of tracks, perforations in the tracks corresponding to binary digits. By arranging successive coded numbers sufficiently closely along the elongate member, great positional accuracy of control can be achieved.

By way of example, one preferred type of elongate member consists of a stainless steel tape which is notionally divided into 16 tracks and has a code number impressed using a suitable binary code every 3 mm. Using 16 tracks this corresponds to a vertical extent of about 208 meters which is sufficient for most uses. The same positional accuracy ca be maintained and the maximum length doubled by adding a further track or alternatively the positional accuracy may be sacrificed by spreading the coded numbers the tape e.g. 5 mm apart. Alternatively it is possible to insert repeated numbers into sections of the tape corresponding to operating sectors of the lift travel where it is not necessary to know precisely where the lift is. For example in a mine shaft it may only be necessary to exercise control over the top and bottom 50 meters of its travel, simple speed monitoring being sufficient during the remainder.

The particular design and operation of the decoding means will naturally depend upon the way in which the elongate member is encoded but a variety of such systems is known and anyone of them may be adapted for use in a lift control system according to the invention. Thus for example a simple electromechanical system of the type used in punch paper tape readers may be used or a sophisticated electronic detection system feeding a microprocessor suitably programmed may also be used.

In either case, signals may be derived from the coded information on the elongate member corresponding to the position of the lift car and to the speed at which the lift car is travelling.

Preferably means are provided for adjusting the position of the elongate member e.g. to compensate for building settlement or stretch in the lift cables. A monitoring means may also be provided to detect any change in dimension of the elongate member e.g. due to stretching or thermal expansion and to produce e.g. a compensation signal to ensure correct operation. Such a change may be sensed directly be sensing movement of the elongate mamber or indirectly, e.g. by sensing temperature changes.

In order to monitor rope condition, or to detect overloading, a second detector/decoder system may be arranged fixed to the customary counterweight which moves up and down the shaft, and which reads information from the same or a further elongate member arranged in the shaft. Simple comparison of the codes read may generate signals showing rope stretch either as a result of wear or overloading.

Preferably the detection and control means are electronic and have no moving parts. This leads to great reliability as well as other advantages. Thus in particular there is no necessity when installing control systems according to the invention to have substantial quantities of wiring down the lift shaft. This also reduces to a minimum maintenance work on the control system.

Particularly, in the case of microprocessor control systems, these are very easy to reprogramme as desired.

One very substantial advantage of the control system according to the present invention is that the monitoring of car position is continuous and is not interrupted in the event of an intermittent power failure. The positional information is effectively fixed and continuously sampled.

Although the above description and the specific description which appears below refer to systems for controlling a single lift, it is of course possible to apply the present invention to the control of sets of lifts in buildings and other installations. In such a case, each lift car has an associated elongate codebearing member and each such member has its own detector. However, centralised signal processing apparatus may be used to control all the lifts in one installation.

By providing appropriate means it is possible to allow the control system of the present invention to be adjusted for relevelling cars, or for allowing one car to be moved relative to another in an emergency in order to enable passengers to be transferred from one car to another. This latter feature is of particular value in the case of pairs of lifts in underground installations such as mines and subway stations. It is also possible to optimise flight times while never exceeding predetermined acceleration and deceleration values. The signals derived from reading the coded information on the elongate member may be used to give multiple zone and acceleration and deceleration of the lift car to the motor control circuits. The system of the present invention can be installed in new installations but can equally well be applied to existing lift installations with relative ease.

The system has a peculiar advantage in lift systems which have so-called "short floor conditions", e.g. where a lift shaft runs between two buildings or parts of a building where the floors differ in level by a short distance, e.g. 10 to 50 cms. Such installations commonly have doors on two sides of a lift car, one set opening into one part of the building and the other into the other. Traditional lift control systems have to be duplicated because of mechanical constraints in such circumstances, but the system of the present invention allows control of the car in such cases with no additional problems. The lift can be moved even a few millimeters with accuracy and precision in such short floor conditions.

Figure 1B:
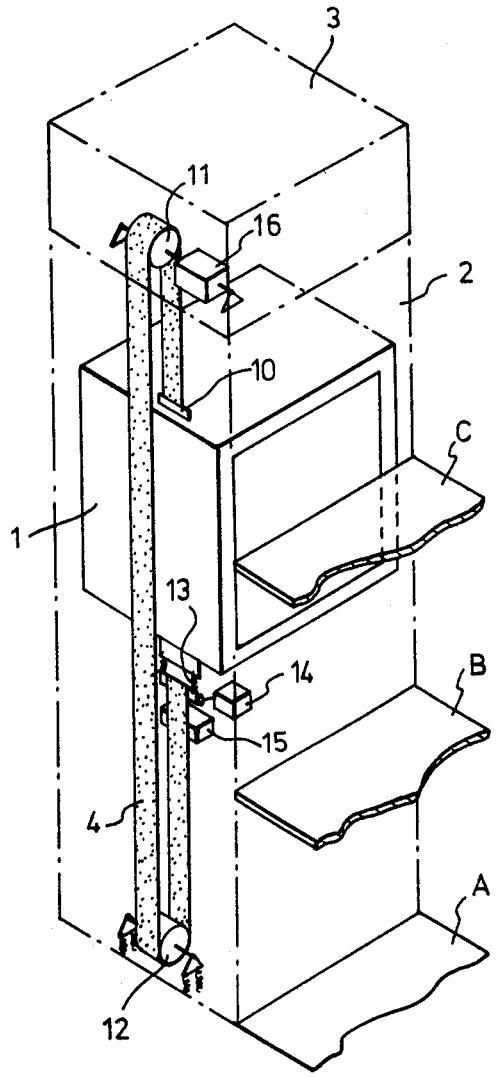
Figure 2:
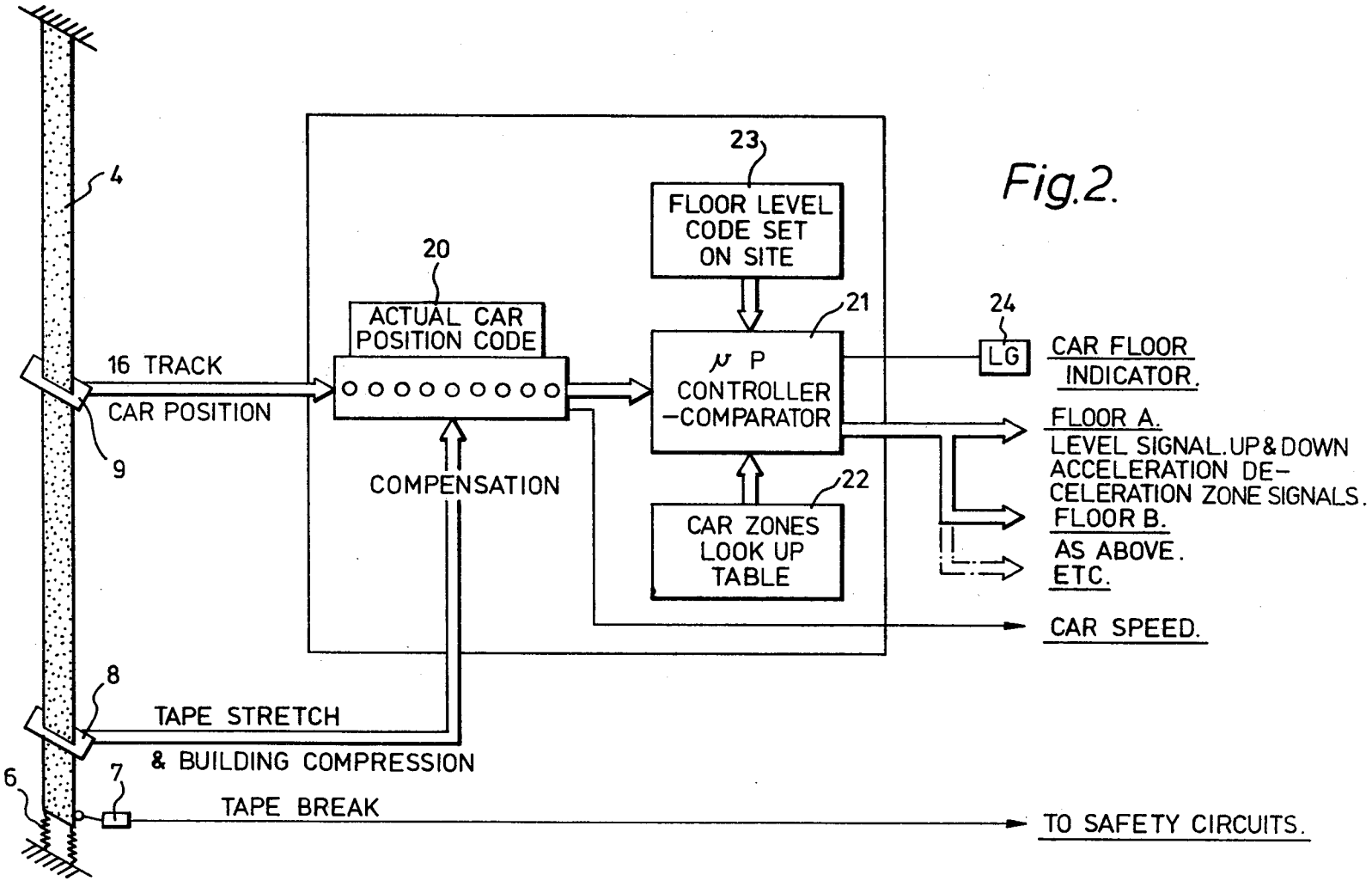

The invention is illustrated by way of example with reference to the accompanying drawings in which:

FIG. 1A is a diagrammatic perspective view of a lift and shaft showing one way of putting the present invention into effect, FIG. 1B is a view similar to 1A but showing an alternative embodiment of the invention, and FIG. 2 is a block diagram of a control system of the invention.

Referring first to FIGS. 1A and 1B these show in both cases a lift car 1 arranged to ride up and down a lift shaft 2 under the control of suitable driving machinery located in an upper motor room 3. In the simplified version shown three floors are indicated denoted A, B and C.

In accordance with the present invention a perforated steel tape 4 is located at one side of the shaft 3.

Referring now specifically to FIG. 1A the tape 4 is fixed in position at 5 in its upper end and mounted via tension springs 6 at its lower end at the bottom of the shaft. A microswitch 7 is located adjacent the lower end of the tape to detect any sudden movement caused by the tape breaking. In addition affixed in position near the lower end of the lift shaft is a tape reader 8 which is arranged to scan the coded information near the bottom of the tape which information will change if the tape expands or contracts due to variations in temperature, building settlement or the like.

Mounted on the lift car 1 is a detector 9 which is adapted to detect information on the tape and decode it appropriately.

In the alternative shown in FIG. 1B, the coded tape 4 is fixedly mounted to the top of the lift car 1 at 10 and runs up the lift shaft, over a pulley 11, down the side of the lift shaft, over a second pulley 12 and up to a tension spring mounting 13 on the base of the lift car 1. Analogously to microswitch 7 and decoder 8 in the embodiment shown in FIG. 1A, a microswitch 14 and decoder 15 are provided for similar purposes. However, instead of providing a decoder on the lift car, in the embodiment of FIG. 1B the positional information is derived from a decoder 16 mounted adjacent pulley 11 in the motor room 3.

In either case the decoder 9 or 16 reads the coded information from the tape and this may then be used to exercise control functions on the lift.

One way of doing this is shown in FIG. 2 of which at the left-hand side shows the vertically extending tape 4 together with a position reader 9, position reader 8 and tension mounting springs 6 and break detector microswitch 7.

Signals from readers 9 and 8 are fed to a decoding unit 20 which decodes the code on the strip 4 into actual position information which may be displayed if desired in any appropriate way. The tape 4 may be coded using any suitable code but it is very preferable to use a weighted code e.g. a grey code which may be verified automatically using parity checks and incremental checking circuits in known fashion to eliminate false signals, and which may be converted at some suitable stage into BCD to be further processed e.g. in a 16-bit microprocessor. The decoder unit 20 takes into account not only the reading of the code from detector 9 but also that from detector 8 so that the car position is compensated for tape stretch and building compression.

A measure of the speed of lift car 1 may be derived from the decoding unit 20 and this can be displayed on a suitable monitor and used for closed loop speed control. It may also be used as one input of a comparator curcuit the other input of which is derived from the lift drive motor. If the inputs differ, it shows that slippage is occurring between the drive motor and the car itself and this may be appropriately detected and displayed as a fault condition.

The position code information appropriately compensated is fed to a microprocessor 21 which may have associated with it appropriate electronic circuitry corresponding to the various position zones over which the lift operates, shown on FIG. 2 as a car zone look up table 22 and additionally a memory bank containing the floor level codes may be provided and is denoted 23. The information may be fed into the microprocessor and associated memories in any appropriate fashion and at appropriate stages of the manufacture or installation of the lift. For example it is convenient to set the floor labels only after the lift has been installed and the car is levelled to the desired floor. The actual position code can then be read from the display 20 and entered into the floor level code table 23.

The microprocessor 21, once appropriately programmed, compares the information it receives from the decoder 20 with information about floor levels and zones and drives a car floor indicator 24 located in the lift car itself and also drives a set of display devices at each floor indicating whether the lift is coming up or down and at which floor it is located. In addition the normal lift call buttons may be installed on each floor and information from them fed into the microprocessor 21 to generate appropriate control signals.

It will be seen without difficulty that the system of the type shown in FIG. 2 is very versatile in operation, relatively simple changes to the operation of the microprocessor being sufficient to change the mode of operation of the lift. Also, changes in operating conditions e.g. relevelling to compensate for cable stretch or building movement can be dealt with easily. In addition the system is easy to instal, particularly in view of the minimum work required internally of the lift shaft itself.

Using microprocessor technology a variety of ways exist for putting the present invention into practice. In particular, the various pieces of information which the microprocessor needs to have stored may be stored in various types of memory. Desirably the system is designed to be pre-programmed to a very substantial extent with the basic control programmes being written in position independent form, allowing the final data peculiar to the lift installation in the particular building, mine or the like to be inserted at the final stage of lift installation. For example, floor position codes may be determined once the lift is installed by levelling the lift car with each floor in turn, reading the position code and entering it into an appropriate memory. Preferably a RAM is used, conveniently with suitable battery backup to avoid loss of memory should power failure occur. Such a system may be easily and economically adjusted during regular maintenance of the lift. Alternative memory systems such as plug matrix boards or switch matrices can also be used for storing floor levels if desired. As a further alternative, if desired the floor levels and other data peculiar to an installation could be stored in a PROM which could be simply inserted into a microprocessor system circuit board once having been preprogrammed on site.

The general approach to programming the system may naturally vary widely. One approach is to design the software around a ± zone table held in a PROM connected to a central microprocessor which would also draw on the floor code and other material stored as noted above. The programme would need to enable operation in various modes, for example a set-up mode allowing floor level data and the like to be inserted, a test mode enabling system data to be read out directly, for example tape stretch, and an operating mode in which the system will function to control the movement of the lift car in accordance with the desires of the users and will also monitor and report any emergency situations which may arise, for example car overloading or tape rupture. If a separate tape were provided in association with the lift counterweight, this could also feed data which would normally be used to generate compensation signals as noted above but which could also be used automatically in an emergency if the main control tape were to break.

In operation the basic routing of the programme would be to monitor the tape or tapes. A mode switch sequence would be provided under the control of an interrupt request but any tape break would be monitored under interrupt control using a non-maskable interrupt. Alternatively, the tape break sensor could be arranged to feed a signal directly to the main lift controller. Power failure and power on should be interrupt controlled in order to ensure all output signals are in a safe mode until the tape reading has been read and verified.

As noted above, it is convenient to use a 16 -bit microprocessor as the core of a practical system, for example one supplied by Motorola under designation 6809. Such a microprocessor, together with appropriate memory chips may be built on to a single printed cicuit board to give a central lift control system which is easy to maintain or reprogram and relatively inexpensive to instal. It is also physically of very small dimensions.

We claim:

1. A lift position control system for controlling the position of a lift in a lift shaft which system comprises, extending vertically down the lift shaft for substantially the whole of its height, an elongate code bearing number, the member having sequentially positioned along its length the sequence of coded units of information, the system comprising means cooperating with the elongate member and adapted to detect and decode the coded markings thereon and to derive therefrom information concerning the position of the lift, means for controlling the operation of a lift drive motor in dependence upon the positional information so detected and decoded, and monitoring means to detect changes in dimensions of the elongate member and produce a compensation signal dependent thereon.

2. A lift position control system according to claim 1 wherein the coded elongate member is fixed in position in the lift shaft and the means for detecting the markings thereon move with the lift car.

3. A lift position control system according to claim 1 wherein the elongate code member is a flat metal ribbon having coded perforations therein.

4. A lift position control system according to claim 1 wherein signals are derived from the coded information on the elongate member corresponding to the position of the left car and to the speed at which the lift car is travelling.

5. A lift position control system according to claim 1 further including means for adjusting the position of the elongate member in the direction of its length.

6. A lift position control system for controlling the position of a lift in a lift shaft which system comprises, extending vertically down the lift shaft for substantially the whole of its height, an elongate code bearing member, the member having sequentially positioned along its length the sequence coded units of information, the system comprising means cooperating with the elongate member and adapted to detect and decode the coded markings thereon and to derive therefrom information concerning the position of the lift, means for controlling the operation of a lift drive motor in dependence upon the positional information so detected and decoded, and means cooperating with a counterweight attached to the lift car via ropes and adapted to monitor and detect rope wear or car overload conditions when compared to signals derived from the detecting and decoding means.

7. A lift position control system according to claim 6 wherein the coded elongate member is fixed in position in the lift shaft and the means for detecting the markings thereon move with the lift car.

8. A lift position control system according to claim 6 wherein the elongate code member is a flat metal ribbon having coded perforations therein.

9. A lift position control system according to claim 6 wherein signals are derived from the coded information on the elongate member corresponding to the position of the lift car and to the speed at which the lift car is travelling.

10. A lift position control system according to claim 6 and including means for adjusting the position of the elongate member in the direction of its length.

11. A lift position control system according to claim 6 and including monitoring means to detect changes in dimensions of the elongate member and produce a compensation signal dependent thereon.

12. A lift position control system according to any one of claims 1 to 11 wherein said means cooperating comprises a microprocessor and associated memory elements, the memory elements including software to cause the microprocessor to function in the desired fashion and including data representative of floor levels corresponding to the desired stopping position of the lift car.

* * * * *